US005444931A

United States Patent [19]

Hillstrom

[11] Patent Number: 5,444,931

[45] Date of Patent: Aug. 29, 1995

[54] SWING ARM MECHANISM FOR WALL SIGN

[75] Inventor: Brian J. Hillstrom, Milford, Mich.

[73] Assignee: Marketing Displays, Inc., Farmington Hills, Mich.

[21] Appl. No.: 172,548

[22] Filed: Dec. 23, 1993

[51] Int. Cl.[6] ..... G09F 13/04

[52] U.S. Cl. ..... 40/564; 40/574

[58] Field of Search ..... 40/564, 574

[56] References Cited

U.S. PATENT DOCUMENTS

| | | | |
|---|---|---|---|
| 1,686,615 | 10/1928 | Balnojan . | |
| 2,029,221 | 1/1936 | Burgess et al. | 40/574 |
| 3,013,475 | 12/1961 | Spangler | 40/574 |
| 3,665,459 | 5/1972 | Dupree et al. | 40/574 X |
| 4,430,819 | 2/1984 | Chandler | 40/564 |
| 4,452,000 | 6/1984 | Gandy | 40/574 |
| 4,512,098 | 4/1985 | Ready et al. | 40/610 |
| 4,802,296 | 2/1989 | Kovalak, Jr. | 40/607 |
| 4,817,317 | 4/1989 | Kovalak, Jr. | 40/603 |
| 5,020,252 | 6/1991 | De Boef | 40/564 |
| 5,044,102 | 9/1991 | Finch et al. | 40/603 |
| 5,188,453 | 2/1993 | Subisak et al. . | |

FOREIGN PATENT DOCUMENTS

| | | | |
|---|---|---|---|
| 750111 | 1/1967 | Canada | 40/574 |
| 721217 | 12/1931 | France . | |

*Primary Examiner*—Kenneth J. Dorner
*Assistant Examiner*—Joanne Silbermann
*Attorney, Agent, or Firm*—Brooks & Kushman

[57] ABSTRACT

A mechanism for improving the installation and access to the interior of large illuminated signs and lightboxes is disclosed. A plurality of rotatable arm members are connected between light modules mounted on a building or wall surface and a removable front panel module. Mating pairs of brackets hold the two modules together when they are coupled. In order to gain access to the interior of the lightbox, the brackets are disconnected and the front panel module is rotated via the arm members to another position adjacent the light module.

12 Claims, 5 Drawing Sheets

SWING ARM MECHANISM FOR WALL SIGN

TECHNICAL BACKGROUND

The present invention relates to internally illuminated signs and lightboxes and particularly to mechanisms for allowing easier assembly of such devices and easier access for modification or change of components.

BACKGROUND OF THE INVENTION

Internally illuminated signs and lightboxes are used in many different applications today. They are predominantly used for advertising and promotion of various goods and services, although they also have uses for providing aesthetic and safety lighting on buildings and other structures.

Known lightboxes typically use two or more fluorescent lights for illumination and have a transparent or translucent front panel that provides the desired picture or message when backlit. When large lightboxes are provided, difficulties have been encountered in their construction and assembly, and also relative to access for changing the lights or any of the internal components. When the lightboxes are 10–20 feet in length, they typically weigh on the order of several hundred pounds and require several men and considerable effort in order to be installed and assembled in place. Typically, a crane or similar equipment is needed to install and modify such structures.

It is an object of the present invention to provide an improved wall-mounted internally illuminated lightbox or sign which is easier to install than known lightboxes and signs. It is another object of the present invention to provide a lightbox or illuminated sign which can be installed in a faster manner with less effort than known lightboxes and illuminated signs.

It is another object of the present invention to provide a mechanism which allows the portion of the lightbox illuminated sign to be held together to the other components and yet be moved to a second position allowing ease of access to the internal portions of the lightbox.

These and other objects, features and benefits of the invention will become apparent from the following description of the invention, together with the drawings and appended claims.

SUMMARY OF THE INVENTION

In accordance with the present invention, a lightbox or illuminated sign is provided for a building or other wall structure. One or more light modules and a light dispersion member are mounted on the building surface, together with the necessary electrical components and mounting brackets. The front panel module of the lightbox with a stretched transparent panel is connected by a plurality of rotatable arms to the first module mounted on the building. For assembly of the completed lightbox, the panel module is rotated by the arms into a position covering the light modules and other components. Mating brackets on the panel module and the light modules are secured together holding the entire lightbox assembly together and in place.

DESCRIPTION OF THE PREFERRED EMBODIMENT

Figure 1:
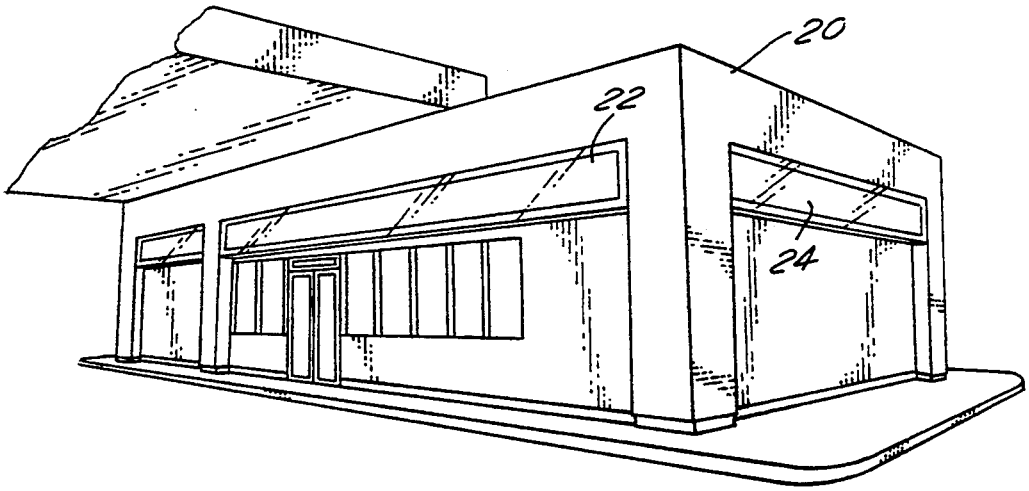
FIG. 1 illustrates the use of the present invention on a service station or convenience store.
Figure 2:
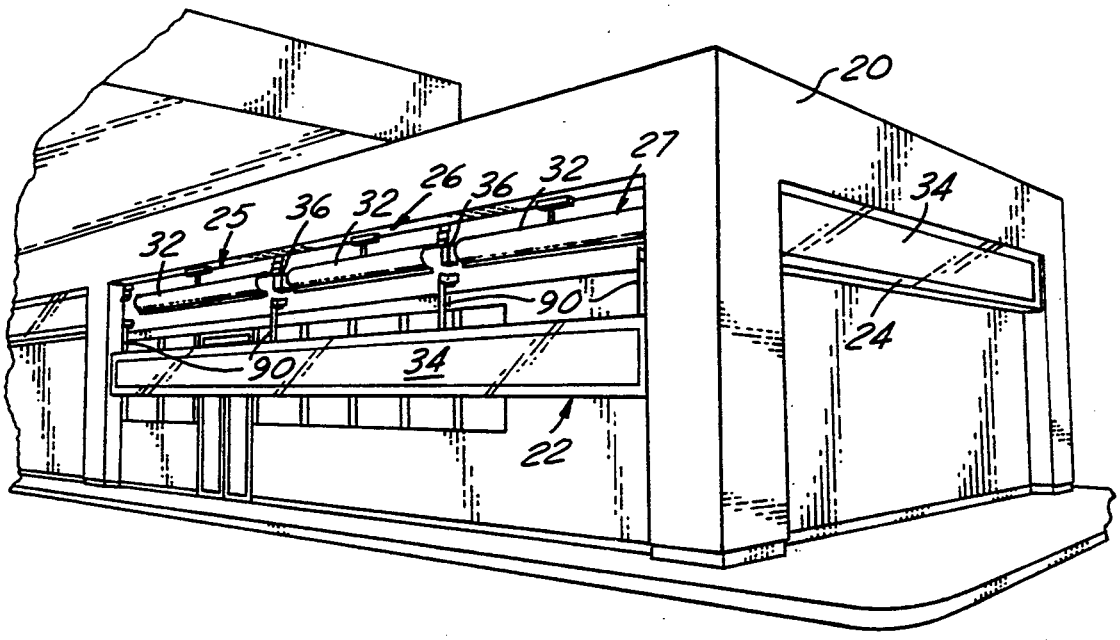
FIG. 2 illustrates the feature of the invention whereby the front panel can be rotated away from the light modules.
Figure 3:
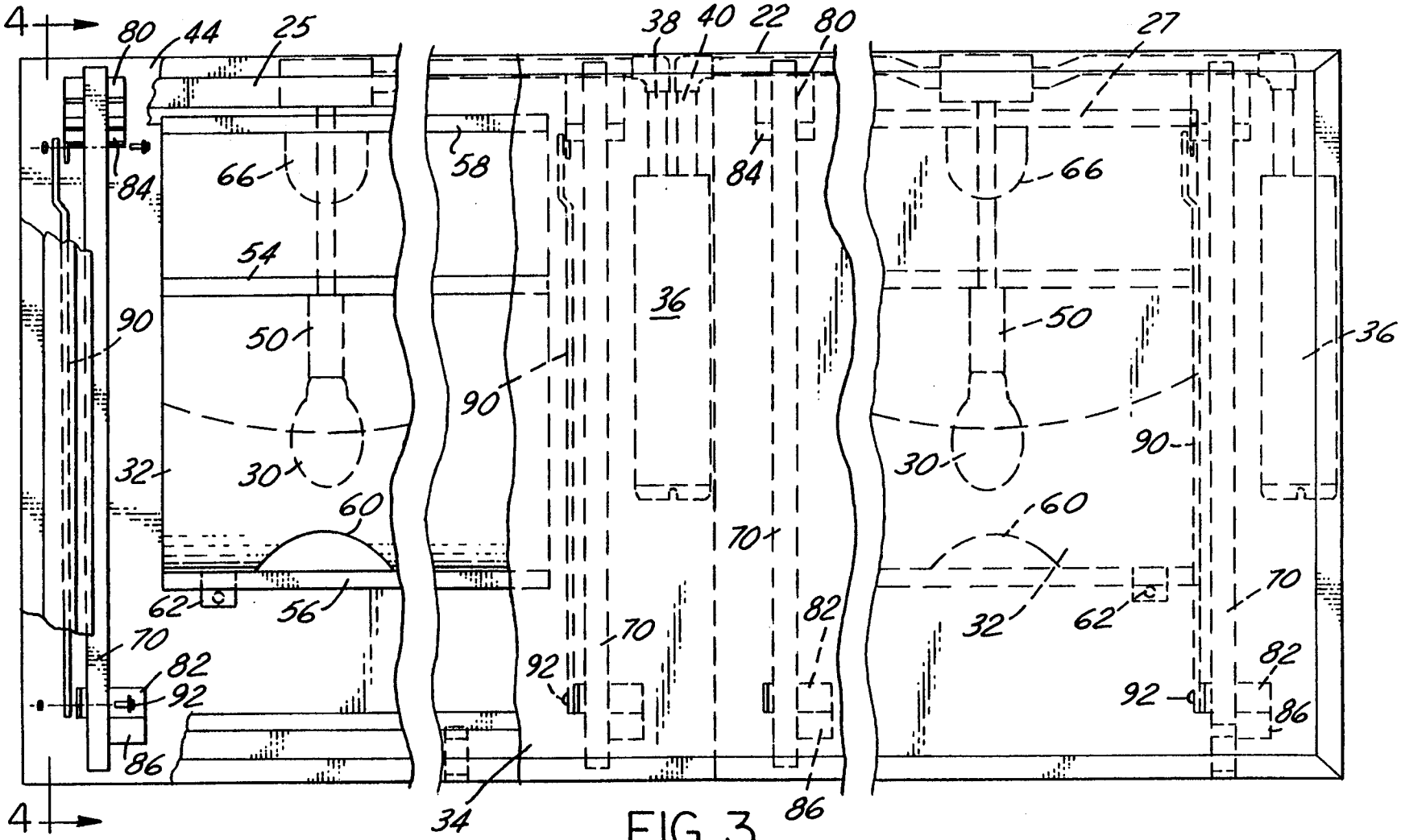
FIG. 3 is a front plane view of the lightbox in accordance with the present invention with a portion of the front panel removed.

The preferred embodiment of the present invention is shown in FIGS. 1–11. As shown in FIGS. 1 and 2, the present invention is shown mounted on two wall surfaces of a gasoline service station. For reference purposes, the building is referred to by the reference number 20 in the drawings and the lightboxes are referred to generally by the reference numerals 22 and 24. It is understood that the present invention can be used on any wall surface or structure in which a lightbox or illuminated sign is desired. It is also understood that the lightbox can be of any size, length and shape, although the present invention is particularly suited for lightboxes and illuminated signs which have substantial length and significant weight. Typically, the present invention is used with illuminated signs which are 10, 20 or more feet in length, 2–3 feet in height, and weigh several hundred pounds.

In constructing and assembling large lightboxes and illuminated signs, it is believed that it is easier and more economical to provide the lightboxes and signs in modules as complete as possible so that there is a minimal assembly on the actual installation site. Also, once at the installation site, it was found that it was difficult to install and assembly several of the components due to their weight and thus several persons at considerable effort were needed to secure the final installation.

In accordance with the present invention, after the wall surface is prepared, the lighting components are assembled in modules. Three modules 25, 26 and 27 are shown in FIG. 2. Each of these modules is typically 6–8 feet in length. On the side surface of the building 20, illuminated sign 24 can have one or more light modules, depending on its precise length.

In accordance with the present invention, preferably point light sources such as metal halide lamps 30 are utilized rather than fluorescent lights. (It is understood, however, that the present invention can be used with lightboxes having fluorescent lights or any other light source.) The lights 30 are spaced along the length of the illuminated sign and preferably one light provided for each module 25, 26, 27. A light dispersion member 32 is positioned in front of the lights 30 and used to evenly distribute the light from the point light source along the front face 34 of the illuminated sign or lightbox. Lightboxes having point light sources and dispersion members of this type are shown and described in application Ser. No. 996,103, filed on Dec. 23, 1992, now U.S. Pat. No. 5,381,324, and assigned to the same assignee as the present invention. The disclosure of application Ser. No. 996,103 is hereby incorporated herein by reference.

Figure 4:
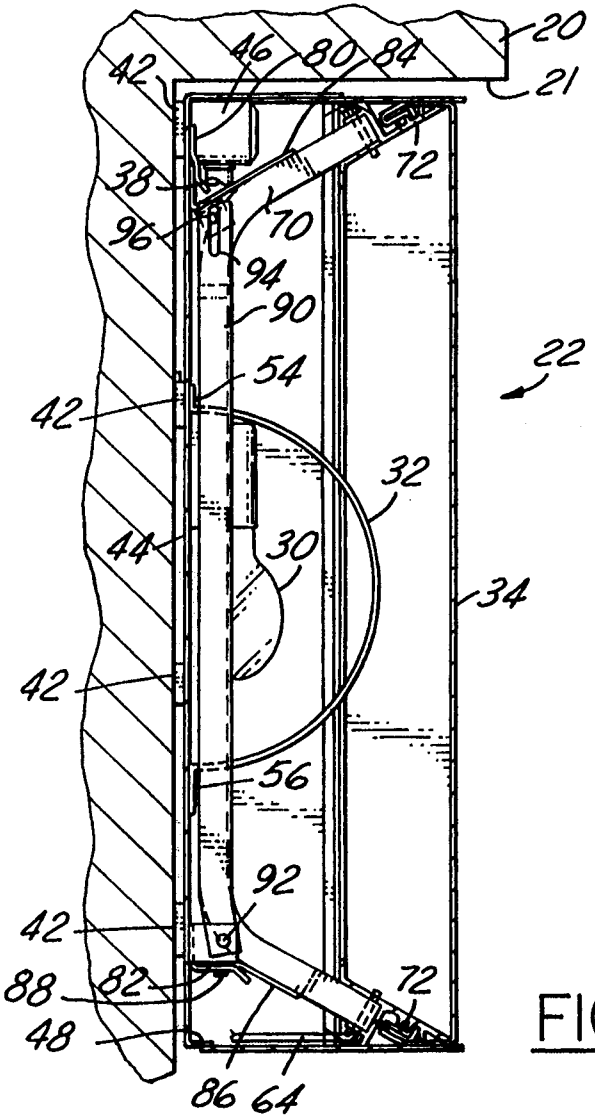
FIG. 4 is a side cross-sectional view of the invention as shown in FIG. 3 and taken along lines 4—4 in FIG. 3.

In accordance with the present invention, the diffusion member 32 can be essentially a curved half circle as shown in FIG. 4, a slightly curved structure spaced a distance away from the rear surface, or a flat structure positioned in the central internal area of the lightbox.

Power for the lights 32 is provided by ballast members 36 which are connected to the lights by connectors 38 and 40. The ballast members in turn are connected to a conventional power source (not shown).

Figure 5:
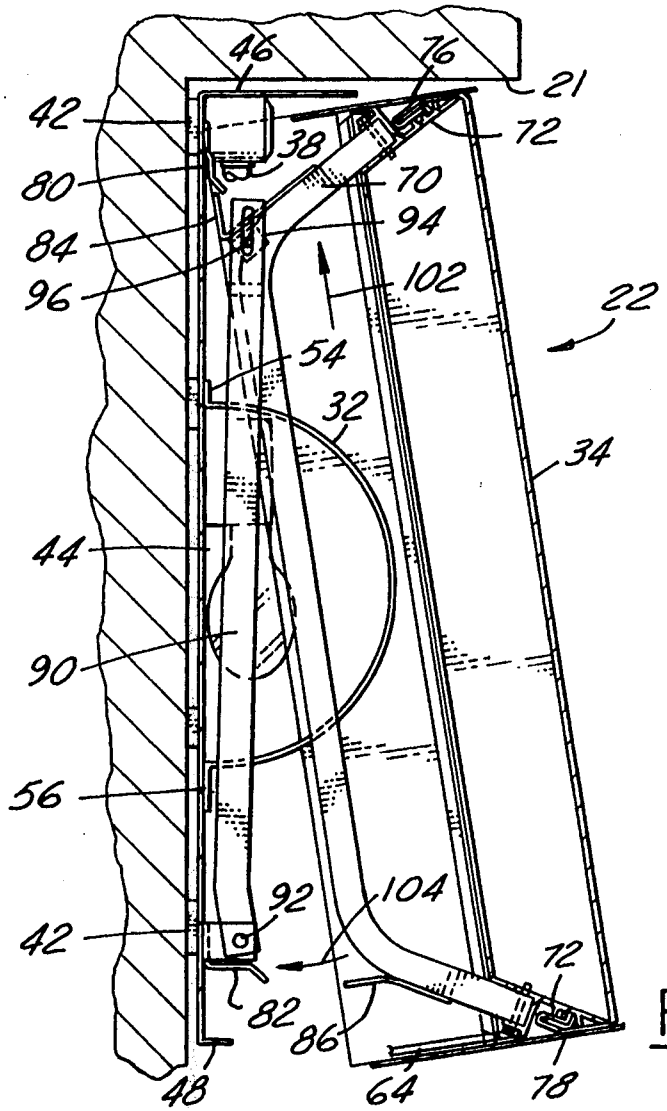
FIG. 5 is a cross-sectional view similar to FIG. 4 and illustrating an intermediate position in the rotation of the front panel.

The dispersion member 32 can be self-supporting as shown in FIGS. 4 and 5, or can have a contiguous clear backing member such as polycarbonate, in order to support and retain a desired shape. In addition, as shown in FIG. 6, the dispersion member 32 optionally can be looped over a backing member 33.

Figure 6:
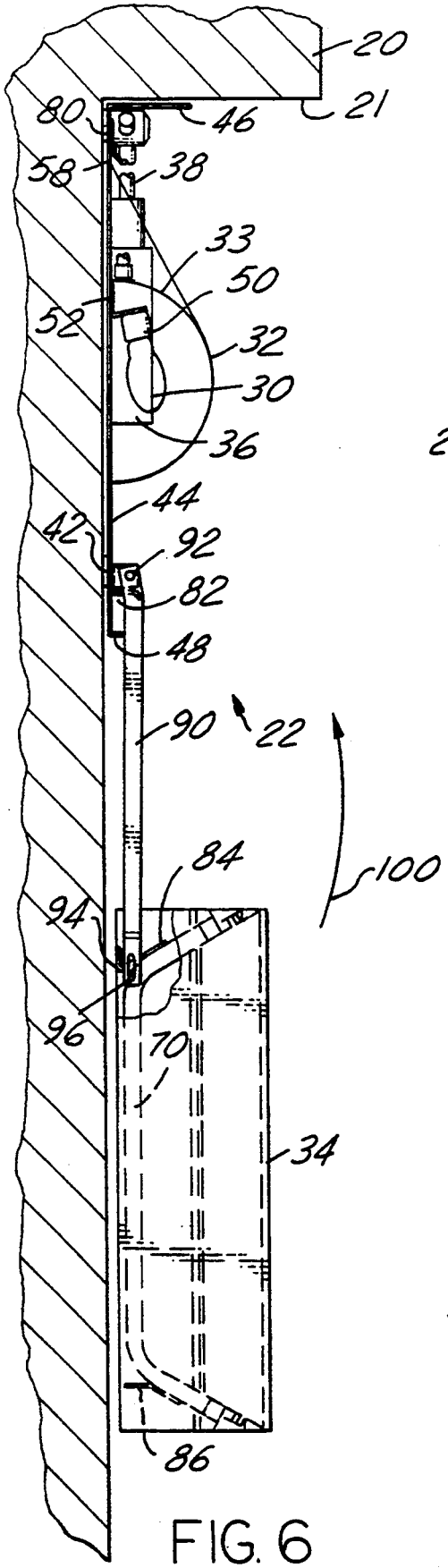
FIG. 6 is similar to FIGS. 4 and 5 and shows the front panel module in its fully rotated position.
Figure 7:
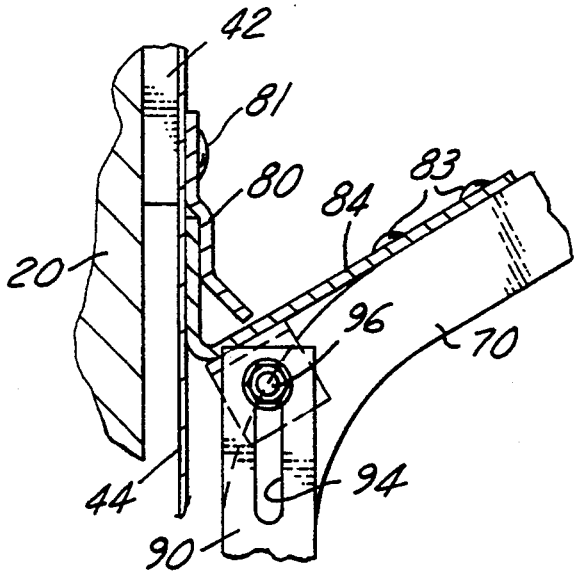
FIGS. 7 and 8 are enlarged views of the mating bracket structures of the front panel module with the light module.
Figure 8:
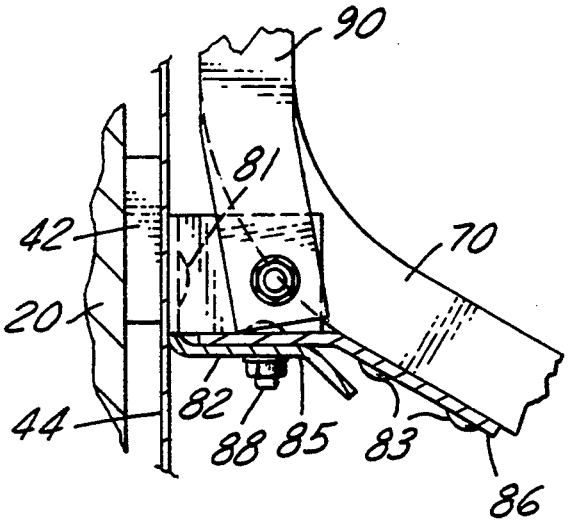
Figure 9:
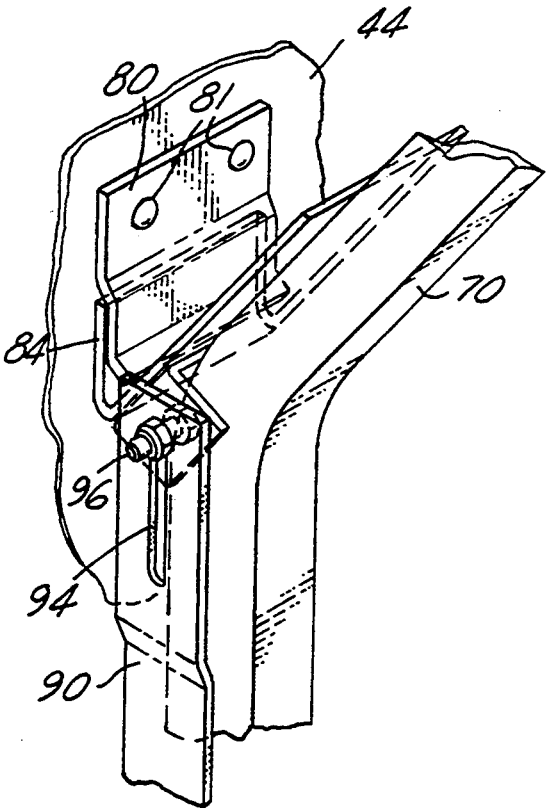
FIGS. 9 and 10 are perspective views of the mating bracket structures shown in FIGS. 7 and 8, respectively.
Figure 10:
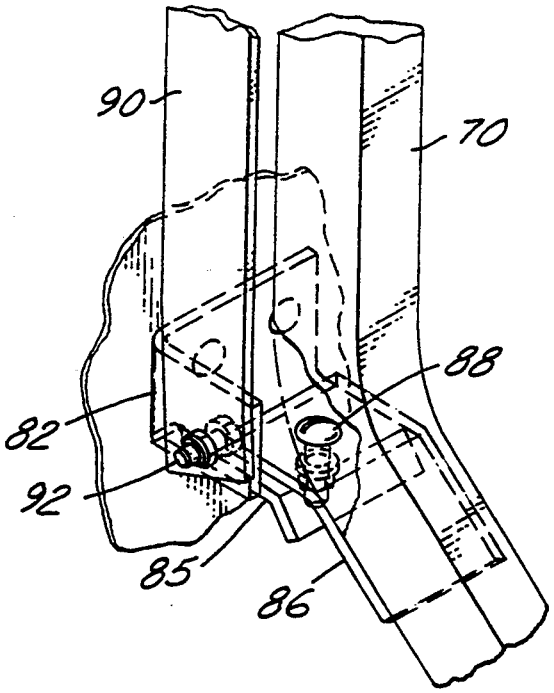
Figure 11:
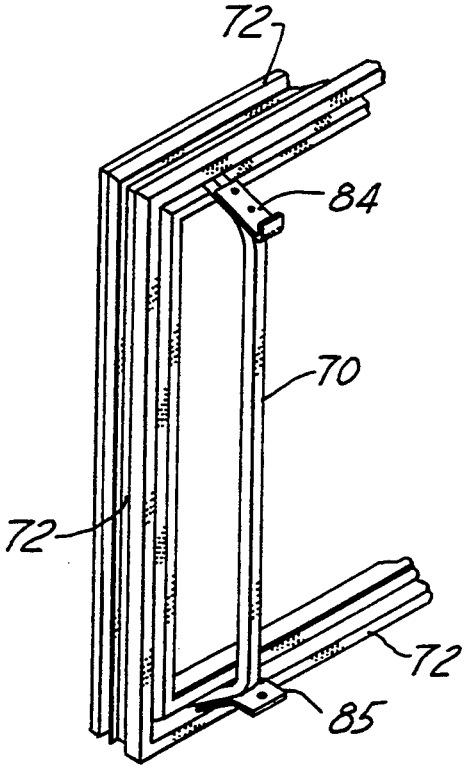
FIG. 11 is a perspective view illustrating the end or corner structure of the lightbox.

As shown in FIGS. 4–6, the lightbox 22 is connected to a building 20 and particularly adapted for use where there is a close overhang on the building, such as shown by reference numeral 21. It is understood, of course, that the present invention can be used on any building or wall surface regardless of whether an overhang is present.

After the wall surface is cleared and prepared for the illuminated sign 22, the plurality of furring strips 42, backing sheets or the like are secured to the surface in a conventional manner. The light modules and other rear portions of the lightbox are then attached to the furring strips 42. In particular, the modules 25, 26, 27 contain rear aluminum panels 44. The rear panels 44 include elongated bent flange members 46 and 48 along the top and bottom edges, respectively. Aluminum panels 44 and flange members 46 and 48 comprise a first housing portion for the invention. The sockets 50 which hold the lights 30 are attached to the rear panel 44 by brackets 52. The ballast 36 and electrical wiring connectors and conduits 38 and 40 are also attached to the panels 44 along with the diffuser members 32 (with or without the supporting backing member). The support and dispersion member 32 are attached to the rear panel member by elongated strips or brackets 54 and 56. If the light dispersion member is of the type shown in FIG. 6, then it is separately attached at the upper portion by a similar bracket 58.

When the erected lightbox is complete, an access opening is preferably provided in the lower panel member in order to manually gain access to the lights 30 when they need changing or replacing. Similarly, if needed, openings 60 can be provided in the dispersion member 32. Alternately, the lower edge or bracket 56 of the dispersion member 32 (and support member if provided) can be releasably attached to the rear panel 44 by bracket members 62 so that it can be manually detached from the panel for access to the light.

Access to the light bulbs 30, as well as fasteners 88 in order to remove the front panel module, is provided through the access openings in the bottom panels of the lightbox. The openings are preferably covered by elongated glass or clear plastic panels 64 which are set in place and can be manually removed or dislodged. The glass panels also allow the sign to provide down lighting on the wall or other surface below the sign. Alternatively, hinged access doors can be provided in the bottom panels directly beneath each of the lights 30 in order to provide access to change the lights. Access to the fasteners 88 can also be made through the same doors or additional doors in line with the brackets 82.

If desired, upper openings 66 can also be provided in the dispersion layers 32 in order to allow escape of excess heat from lights 30, although such openings are not necessary if the dispersion layer is not directly attached to the rear panel member 44 along its top edge. As indicated above, the dispersion member could be a flat member positioned or suspended between the light source and the front panel 34 or a slightly curved member which is not directly attached along its edges to the rear panel 44.

The front modular portion of the lightbox contains the transparent panel 34 and the supporting frame structure. The front modular portion also is known as the second housing portion of the invention. The supporting frame structure includes a plurality of U-shaped brackets 70 which are to be positioned on each side of the light modules along the length of the wall or building. Elongated frame members 72 are attached to the outer ends of the U-shaped brackets 70 and form the upper and lower front edges of the lightbox. The frame members 72 extend along the full length of the illuminated lightbox 22. Smaller sections of the frame members are used for the two side ends of the panel framing structure. The ends of the four members are mitred and then welded or otherwise securely affixed together to form a rectangular framing structure.

The front panel 34 is stretched over the frame members 72 and securely attached thereto by brackets or other fasteners, as particularly shown in application Ser. No. 996,103. Similarly, the two ends of the frame structure also stretch and attach to the front panel 34. Again, the preferred manner is shown in application Ser. No. 996,103.

Upper elongated panel member 76 and lower elongated panel member 78 are also attached to the bracket members 72 in order to form a modular front panel assembly for the lightbox. These preferably are made from aluminum sheet material. Similar panel members are attached at the two outer ends of the front panel member in order to form a box-like modular structure.

In order to secure the front modular structure which contains the panel 34 to the rear panel structure which is attached to the building 20, a series of upper brackets 80 and a series of lower bracket members 82 are secured to the rear panel member 44. Corresponding brackets 84 and 86 are attached to the upper and lower legs of the U-shaped brackets 70 on the front panel modular structure for mating with the brackets 80 and 82, respectively. The brackets 80 and 82 are attached to the rear panel member 44 by any conventional fasteners, such as screws 81 or pop rivets. Similar fasteners 83 are used to attach brackets 84 and 86 to the U-shaped bracket 70.

When the front modular portion of the lightbox is assembled and installed in place on the building structure, it mates with the rear panel modules previously attached to the building. When the two modular members are attached together, brackets 84 are inserted in the space between brackets 80 and the rear panels 44 and then the lower brackets 86 are positioned over and rest on the outstanding flanges 85 on lower brackets 82. Fasteners 88 are then used to secure sets of brackets 86 and 82 together along the length of the lightbox structure forming a solid unitary structure. This is shown in FIG. 4 and also depicted by the numerals 22 and 24 in FIG. 1. Finally, the glass or clear plastic panels 64 are set in place.

In order to allow the front modular portion of the lightbox to be assembled more easily with the rear modular portion previously attached to the building, as well as to allow ease of removal of the front portion and allow access to the light modules, a plurality of swing-arm members 90 are provided. The members 90 are made of steel or aluminum and are provided at each of the ends of the lightbox and at spaced locations in between. If desired, a swing arm member 90 can be provided on each of the U-shaped brackets 70 along the length of the lightbox structure, although it has been found that fewer number of members 90 are actually needed in practice. As shown in FIG. 2, four spring arm members 90 are provided along the length of the illuminated lightbox structure 22 shown.

The members 90 are pivotally attached to the lower brackets 82 by bolts or pivot pins 92. The opposite end of the members 90 have slots 94 and are attached to brackets 84 by bolts or pivot pins 96. The slots 94 allow movement of the pins 96 and brackets 84 relative to the member 90 in order to provide the movement necessary for brackets 84 and 80 to be mated. This is shown in particular in a comparison of FIG. 5 with FIG. 4, along with FIGS. 7 and 9.

The swing arm members 90 allow the front panel module to be disconnected from the rear module of the lightbox and rotated downwardly against the side of the building. This is shown in FIGS. 5 and 6. When the lightbox 22 is assembled, the rear modular portion with the modular light assemblies is first attached to the building or wall structure 20 as shown in FIG. 6. The front panel member which is either installed on the site or provided to the site as completed at the factory, has the appropriate number of swing arm members 90 attached to the brackets 84. The front modular portion is then lifted to an appropriate height on the building below the rear modular unit (as shown in FIGS. 2 and 6), and the members 90 are then attached to the brackets 82 by the bolts or pivot members 92. The front modular unit can then be self-supporting by the members 90 and allowed to hang below the rear modular member as shown in FIGS. 2 and 6.

In order to complete the assembly of the lightbox structure 22, the front modular portion is rotated as shown by arrow 100 in FIG. 6 until it assumes the position shown ill FIG. 5. At this point, the brackets 84 on the U-shaped member 70 are mated with the brackets 80 on the rear modular unit and the front modular unit is pushed upwardly an additional distance until the brackets 84 and 80 are tightly mated together. The direction of this force is shown by arrow 102 in FIG. 5. Thereafter, the lower end of the front modular unit is rotated inwardly as shown by arrow 104 in FIG. 5 until the brackets 86 overlap and rest upon the flanges 85 of brackets 82. Fasteners 88 are then installed securely holding the complete lightbox assembly together. Finally, the glass or clear plastic panels 64 are set in place.

In order to remove the front modular structure or to gain access to the interior of the lightbox structure, the above-identified process is simply reversed. First, the panels 64 are removed, then fasteners 88 are removed and the lower end of the front modular unit is rotated outwardly thereby detaching brackets 86 from brackets 82. The modular unit is then simply swung outwardly and lowered until it assumes the position shown in FIG. 6. At this point, the front modular unit is free to hang and all the necessary work can be done to the lights 30 and interior portion of the lightbox.

Although particular embodiments of the present invention have been illustrated in the accompanying drawings and described in the foregoing detailed description, it is to be understood that the present invention is not to be limited to just the embodiments disclosed, but that they are capable of numerous rearrangements, modifications and substitutions without departing from the scope of the claims hereafter.

What is claimed is:

1. An illuminated display device for mounting on a surface comprising:

a housing having a first housing portion adapted for attachment to said surface and a second housing portion removably attached to said first portion;

said first housing portion including a rear panel member and at least one light source;

said second housing portion including a front panel member and a frame structure;

at least two arm members connecting together said first housing portion and said second housing portion;

said arm members being rotatably attached to each of said first and second housing portions;

said second housing portion being rotatable by said bracket members from a first position mated with said first housing portion to a second position separated from said first housing portion;

wherein said second position is immediately below said first housing portion relative to said surface.

2. The illuminated display device of claim 1 further comprising first bracket means connected to said first housing portion and second bracket means connected to said second housing portion, said first bracket means and said second bracket means being mated together when said second housing portion is in said first position.

3. The display device structure of claim 2 wherein said arm members each include a slot adjacent one end, said slot allowing mating of said first and second bracket means when said second housing portion is rotated to said first position.

4. The display device structure of claim 2 wherein said first bracket means comprises a slot member and a shelf member, and said second bracket means comprises a flange member and a rest member, wherein when said second housing portion is assembled in its first position, said flange member mates with said slot member and said rest member mates with said shelf member.

5. An illuminated display device structure for mounting on a surface, said display device comprising:

a housing, said housing having a first portion adapted to be mounted to said surface and a second portion removably attached to said first portion;

said first portion including a rear panel member and at least one light source;

said second portion including a front panel member and a frame structure, at least two rotatable arm members rotatably connected to each of said first portion and said second portion;

wherein said second portion can be separated from said first portion and when separated can be rotated by said arm members to a position adjacent to said surface and adjacent to said first portion.

6. A display device for mounting on a surface comprising:

a first housing portion, a second housing portion removably detachable from said first housing portion and forming the display portion of said display device, at least two rotatable arm members, each arm member having a first end rotatably connected to said first housing portion and a second end rotatably connected to said second housing portion, said second housing portion being movable between a first position mated with said first housing portion and thereby forming said complete display device, and a second position separated from said first housing portion and situated immediately adjacent said first housing portion wherein when said second housing portion is positioned in said second position, it is positioned adjacent said surface immediately below said first housing portion.

7. The display device structure of claim 6 further comprising a slotted bracket member and a shelf bracket member on said first housing portion and a flanged bracket member and rest bracket member on said second housing portion, whereby when said second housing portion is situated in said first position, said flanged bracket member is mated with said slotted bracket member and said rest bracket member is mated with said shelf bracket member.

8. A method of assembly of a display device on a surface, said display device having first and second mating housing portions, the method comprising the steps of:

mounting said first housing portion on said surface, positioning said second housing portion on said surface adjacent said first housing portion, connecting said first and second housing portions together with rotatable arm members such that said second housing portion is hanging vertically below said first housing portion, said arm members being rotatably connected to each of said first and second housing portions, rotating said second housing portion until it mates with said first housing portion, and securing said first and second housing portions together.

9. The display device method of claim 8 wherein said first housing portion includes a rear panel member and illumination means, said second housing portion includes frame means and a translucent front panel member.

10. The display device method of claim 8 wherein said first housing portion includes slotted bracket means and shelf bracket means, and said second housing portion includes flange bracket means and rest bracket means, and wherein said flange bracket means is first mated with said slotted bracket means and said rest bracket means is then positioned on said shelf bracket means when said first and second housing portions are mated together.

11. The display device method of claim 8 wherein said arm members each have two ends, one end connected to said first housing portion and another end connected to said second housing portion.

12. The display device method of claim 8 wherein said arm members are connected first to said second housing portion and then connected to said first housing portion.

* * * * *